United States Patent [19]

Barboza

[11] Patent Number: 4,600,161

[45] Date of Patent: Jul. 15, 1986

[54] METHOD AND APPARATUS FOR STORING ELECTRICAL CONTACT STRIPS

[75] Inventor: Joseph V. Barboza, South Attleboro, Mass.

[73] Assignee: Texas Instruments Incorporated, Dallas, Tex.

[21] Appl. No.: 568,158

[22] Filed: Jan. 4, 1984

[51] Int. Cl.[4] ..... B65H 18/08; B65H 54/28

[52] U.S. Cl. ..... 242/55; 242/67.1 R; 242/158 R; 242/159; 242/DIG. 2

[58] Field of Search ..... 242/55, 54 R, DIG. 2, 242/158 R, 158.1, 158.2, 158.3, 158.4 R, 103, 67.1 R, 67.2, 67.3 R, 159

[56] References Cited

U.S. PATENT DOCUMENTS

| | | | |
|---|---|---|---|
| 2,997,747 | 8/1961 | Russo et al. | 242/159 X |
| 3,023,888 | 3/1962 | Scott | 242/1 |
| 3,458,153 | 7/1969 | Lawrence | 242/158 R |
| 3,794,257 | 2/1974 | Reitter | 242/67.1 R |
| 3,895,708 | 7/1975 | Jureit et al. | 242/55 X |
| 4,349,162 | 9/1982 | Fanning | 242/54 R |
| 4,352,467 | 10/1982 | Dunn et al. | 242/67.3 R X |
| 4,477,036 | 10/1984 | Rundo | 242/67.2 |
| 4,482,100 | 11/1984 | Yoshida | 242/67.1 R X |

*Primary Examiner*—John M. Jillions

*Attorney, Agent, or Firm*—John A. Haug; James P. McAndrews; Melvin Sharp

[57] ABSTRACT

Contact elements depending from a continuous carrier strip along with an interliner are helically wound on a reel in order to provide a sufficient supply of such elements for use with high speed assembly apparatus in which the contact elements are mounted in socket bodies in a continuous fashion. Upper and lower traverse winding stations each include a traversing mechanism mounting an interliner guide and an aligned carrier strip guide. The carrier strip guide is pivotably mounted and has an elliptical tube which extends to the core of the reel and is adapted to follow the diameter of the core as it builds up with layers of carrier strips and interliner and has a carrier strip receiving end which is configured such that a smooth transition surface is presented to the carrier strip in any position the guide assumes.

12 Claims, 9 Drawing Figures

METHOD AND APPARATUS FOR STORING ELECTRICAL CONTACT STRIPS

BACKGROUND OF THE INVENTION

This invention relates generally to electrical contacts for use with electrical sockets for mounting integrated circuits and the like and more particularly to a method and apparatus for storing the contacts in a manner which enhances operation of the socket assembly apparatus with which the contacts are used.

Such sockets generally comprise a body of electrically insulative material having a plurality of contact receiving apertures extending from a top surface down to a bottom surface of the body. A common type of socket has a pair of rows of contact receiving apertures. Depending upon the application for which the socket is to be used, a variety of contact configurations have become common with regard to the spacing between the rows as well as the total number of contacts in a row. One of the most common is a sixteen position or contact socket having two rows of eight contacts with the socket being slightly less than an inch in length. On the other hand, sockets could have many more contact positions and be several inches in length. Although there are many socket variations, it is an accepted industry standard to space the contacts in a row the same distance from one another.

In copending and coassigned application Ser. No. 475,778, filed Mar. 16, 1983, which issued as U.S. Pat. No. 4,523,378 a method and apparatus is described and claimed for assembling contact elements in such sockets which includes directing the socket bodies sequentially onto a track along a first path while a continuous carrier strip having spaced contacts depending therefrom is payed from a reel and directed along a second path which tangentially meets the first path with the contact elements sequentially being received in the contact receiving apertures. The contacts are seated, staked and severed from the carrier strip in a continuous manner.

As stated in the referenced application, sockets can be assembled in accordance with the method and apparatus contained therein at a high rate easily exceeding 1200 inches per minute. However conventional contact strip reels which last for ten minutes or more with slower assembly machines before needing replacement have now become the limiting factor in the assembly since they are depleted so rapidly thereby requiring constant attention and constant reel changing and even shutting down of the apparatus to permit the reel changing. That is, a conventional contact strip reel has a strip of contacts rolled up on itself with an interliner separating contiguous layers from one another that is limited in diameter to a size which can be reasonably handled by an operator. A full reel contains in the order of twenty-eight thousand contacts since the contacts are rather bulky having previously been stamped into their selected configuration. Thus at the rate of 1200 inches per minute it will be seen that a full reel will be emptied in little over two minutes.

SUMMARY OF THE INVENTION

It is an object of the invention to provide an improved contact storing and delivering system for use with socket assembling equipment. Another object is the provision of a contact storage and delivery system which will accommodate significantly increased quantity of contacts and still be capable of convenient handling by an operator. Yet another object of the invention is the provision of a method and apparatus for storing contacts previously formed into a three dimensional configuration with improved density compared to prior art approaches. Other objects and features will be in part apparent and in part pointed out hereinafter.

Briefly, in accordance with the invention, a contact element carrier strip and an interliner are directed onto a reel, significantly wider than the strip, and are wound onto the reel with a traverse mechanism so that a contact strip layer is disposed adjacent to the immediately preceeding contact strip layer but with an edge of the interliner extending beyond the contact strip overlapping an edge of the interliner of the immediately preceeding layer in order to increase the density of the contacts per unit volume of the reel. The interliner is directed over each contact strip layer and, although it can be provided so that the interliner is essentially the same width as that of the core of the reel, it is preferred, in order to maximize packing density, to select the width of the interliner so that it extends only slightly over both sides of the contact strip and to wind the interliner on top of the carrier strip with the same traverse mechanism to ensure proper alignment of the two strips relative to one another and to maintain control of the guidance of the carrier strip right up to its placement on the reel through an improved, pivotal guiding means. The guiding means includes an elliptical carrier strip receiving tube having a major axis greater than the width of the carrier strip and a minor axis less than the width of the carrier strip to ensure proper orientation of the carrier strip as it is received on the reel. One end of the pivotal guiding means is curved downwardly so that as the guiding means pivots due to the increasing effective diameter of the core as the layers build up a smooth transition surface will be presented to the carrier strip as it is received on the guiding means. The improved carrier strip guide means ensures that the carrier strip is placed on the reel at the optimum position relative to the interliner.

BRIEF DESCRIPTION OF THE DRAWINGS

The above summary will become more clear from a detailed description in connection with the accompanying drawings wherein.

Figure 2:
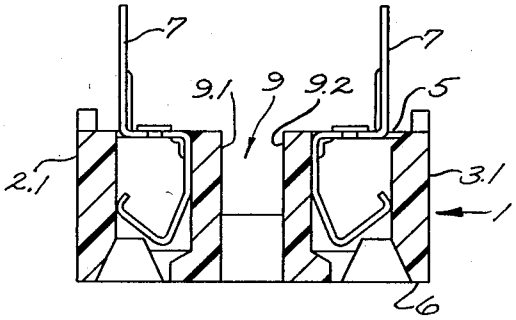
FIG. 2 is a cross section of the socket of FIG. 1 showing a contact receiving aperture in each of two rows with a contact element received in each aperture.

Dimensions of certain parts as shown in the drawings may have been modified or exaggerated for the purpose of clarity of illustration.

DESCRIPTION OF THE PREFERRED EMBODIMENT

Figure 1:
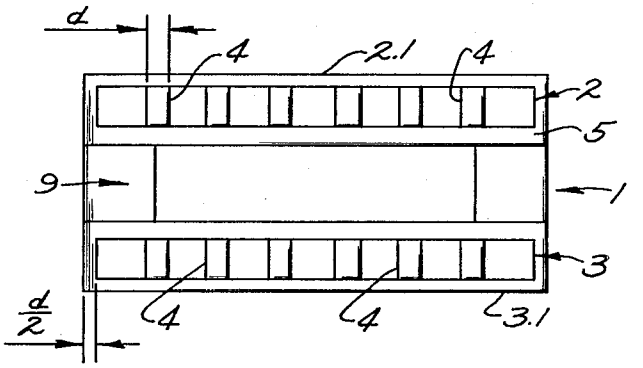
FIG. 1 is a plan view of an electrical socket into which electrical contacts are to be assembled.

Referring now to the drawings, a typical socket body into which contact elements are to be assembled in accordance with the invention is shown in FIG. 1, indicated by the numeral 1, comprising first and second parallelly extending rows 2 and 3 of contact receiving apertures 4 extending from the top surface 5 to the bottom surface 6. FIG. 2 shows contact element 7 received in respective contact receiving apertures after they have been assembled into the socket body.

Figure 3:
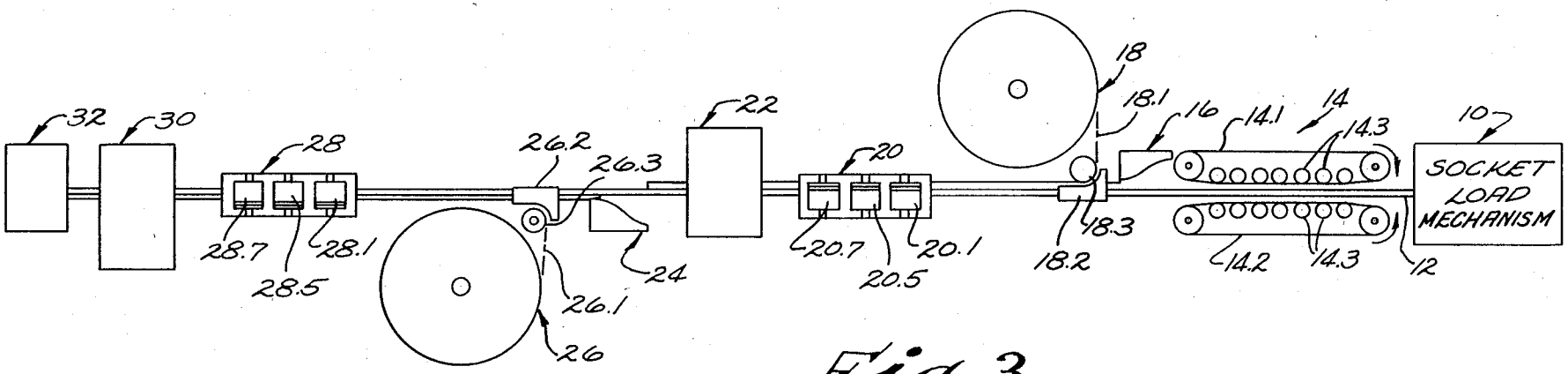
FIG. 3 is a schematic diagram showing apparatus for assembling contact elements into socket bodies.

FIG. 3 schematically depicts the several stations and paths involved in assembling contacts into socket bodies starting with any suitable socket loading mechanism 10 adapted to place a supply of socket bodies 1, one body after another, lengthwise onto a track 12 and into a drive station 14. Drive station 14 comprises opposed endless belts 14.1 and 14.2 disposed on opposite sides of track 12 and adapted to frictionally engage opposed sides of the bodies and move them along a first path through the several stations of the apparatus. A series of idler rolls 14.3 are movably mounted within the area circumscribed by each belt 14.1 and are biased against the belt to impart a selected force to the bodies disposed therebetween.

After exiting the drive station 14 the bodies are referenced to one side of the track by a cam 16 so that one of the rows 2 and 3 is a predetermined distance from the side of the track. With reference again to FIG. 1 it should be pointed out that the distance that row 2 of apertures 4 and side 2.1 of body 1 is identical to the distance that row 3 of apertures 4 from side 3.1 and that the spacing between adjacent apertures in a row is uniform and equal to "d" while the spacing between the first and last aperture in a row to the closest end of the body is one half "d".

After the bodies are cammed to one side of the track 12, a continuous carrier strip having elongated contact elements depending therefrom is directed from a suitable supply, such as a conventional large reel 18, along a suitable second path 18.1 into a guide rail means 18.2 with the first and second paths adapted to converge and meet one another tangentially with the contact elements received sequentially in the contact receiving aperture of the row closest to the referenced side of the body, e.g. row 2 shown in FIG. 1. One of the first and second paths is formed with a curved portion to accommodate reception of the contact elements into receiving apertures.

Motion from the bodies is transferred to the carrier web through the contact elements once they are received in their respective apertures so that the carrier strip may be pulled out of the reel as needed, assuring proper alignment of the contact elements, which are spaced a distance "d" from one another on the carrier, with respective contact element receiving apertures. After the contact elements are received in their respective apertures, the bodies are passed through a seating and staking station 20. The contact elements are engaged by a seating surface in order to insure that the elements are fully seated in their apertures. This is followed by deforming a selected portion of the body onto the seated contact element to securely maintain the contact elements in their seats. As shown in the figures, two staking rollers are employed for this purpose to incrementally deform a protrusion onto a traversely extending portion of the contact element.

Following the seating and staking station the bodies are received at severing station 22 where the contact elements are severed from the carrier strip.

The bodies, freed from the carrier strip but still driven by upstream bodies, are referenced to the other side of the track by cam 24 so that side 3.1 body 1 and hence row 3 is at the same predetermined distance from that side of the track as was row 2 when it received its contact elements as described above.

A second continuous carrier strip with depending contact elements is supplied from a suitable reel 26 and directed along a third path into a guide rail means 26.2 with the first and third paths adapted to converge and meet one another tangentially with the contacts received sequentially in the contact receiving apertures of the row closest to the referenced side of the body, e.g. row 3 shown in FIG. 1. As in the case of the first and second paths, at least one of the first and third paths is formed with a curved portion to accommodate reception of the contact elements in the contact element receiving apertures.

After the contact elements are received in their respective apertures, the bodies are passed through a sealing and staking station 28 similar to station 20 for the row 2 of apertures, and then are passed through severing station 30 where the contact elements of row 3 are severed from the carrier strip thereby completing the assembly of the electrical socket. The sockets are finally received in a suitable storage or shipping means 32 for eventual use.

Further details of the method and apparatus for assembling contacts in the socket bodies may be had by referring to the above referenced patent No. 4,523,378.

As stated above, the throughput of the socket assembly machine is so great that supplying the contacts via reels 18 and 26 have become a limiting factor in such assembly due to their limited capacity.

Figure 4:
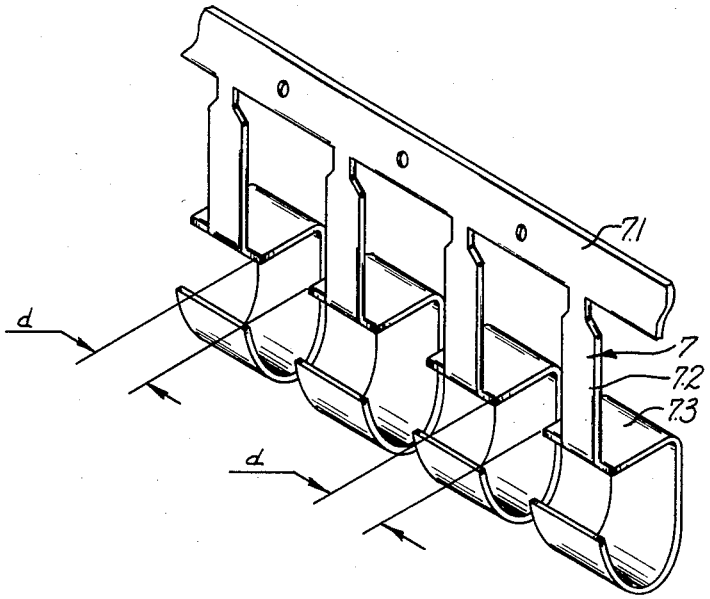
FIG. 4 is a perspective view of a portion of a carrier strip with contact elements depending therefrom.
Figure 5:
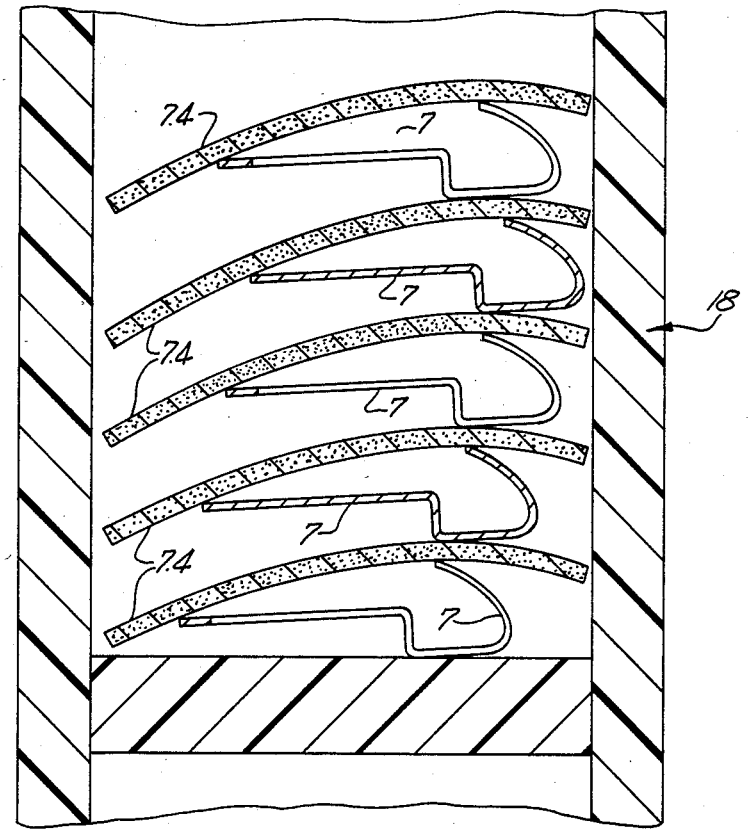
FIG. 5 is a cross sectional view of a portion of a conventional contact strip reel showing several layers of contacts wound on the reel.

As seen in FIG. 4, the contact strip comprises a carrier or selvedge portion 7.1 from which depend contact elements 7 at a distance "d" from one another. Contact elements 7 include a first post portion 7.2 which essentially lies in the plane of the carrier 7.1 and a second contact portion 7.3 which is formed out of the plane of carrier 7.1 into a three dimensional configuration. In FIG. 5 several layers of contact strips are shown wound on a conventional reel 18 with a paper or plastic interliner 7.4, somewhat wider than the width of contact strip comprising carrier 7.1 and contact elements 7 depending therefrom so that the contacts of one layer are separated from the contacts of a contiguous layer to prevent any possible fouling of the contacts. As shown in FIG. 5, as the contact layers build up from the core of the reel, the layers come closer and closer to one face of the reel and then the trend is reversed with the layers coming closer to the opposite face. However space between the end faces of the reel is chosen so that there is only a single row of contacts wound on top of each other. The three dimensional configuration of the contact portion 7.3 results in having a substantial amount of unoccupied space in the reel with approximately twenty-eight thousand accommodated in a full reel.

Figure 6:
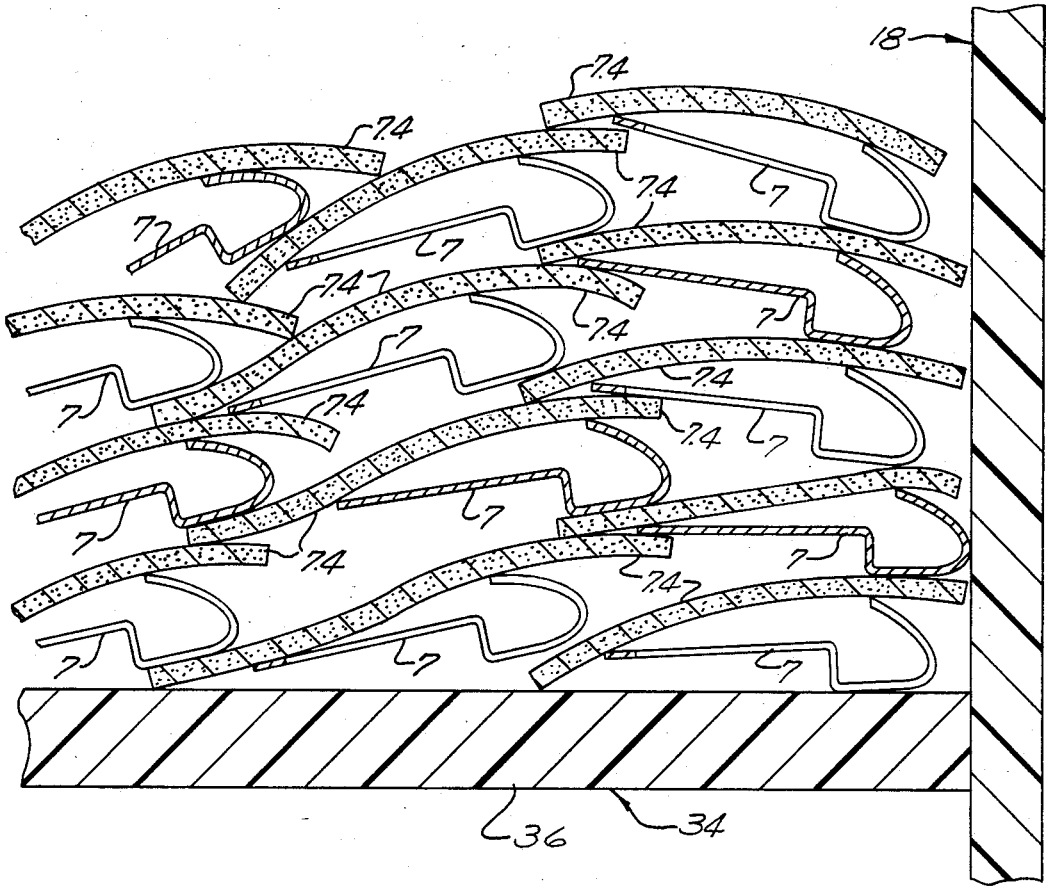
FIG. 6 is a view similar to FIG. 5 showing several contact layers helically or traverse wound in accordance with the invention on a reel significantly wider than that of FIG. 5.

In accordance with the invention as seen in FIG. 6, a reel 34 is employed having a core 36 substantially wider than that used for reel 18 so that the contact strip can be helically wound on core 36 to greatly increase the contacts accommodated in a full reel and to thereby enable the assembly apparatus to realize its full potential, that is, without having to unduly interrupt the assembly process to replace depleted reels. Although reels still have to be replaced, reels used with the present invention can accommodate at least in the order of 350,000 contacts so that by providing a back up set of reels, an operator can switch from a first reel to a back up reel and then replace the first reel for use as the next back up reel without having to materially interrupt the assembly process. Preferably the contact strip is directed onto reel 34 so that a layer lies adjacent to the immediately preceeding layer and so that the overlying interliner overlaps the interliner of the preceeding layer by an amount approximately the same as that portion of the interliner extending beyond the contact strip so that a greater number of contact layers are received per unit volume of the storage area compared to the contact layers of reel 18, while limiting undesirable forces on individual contacts which could occur if the contact layers overlapped one another. Thus the contact layers are nestled in together transversely along core 36.

Figure 7:
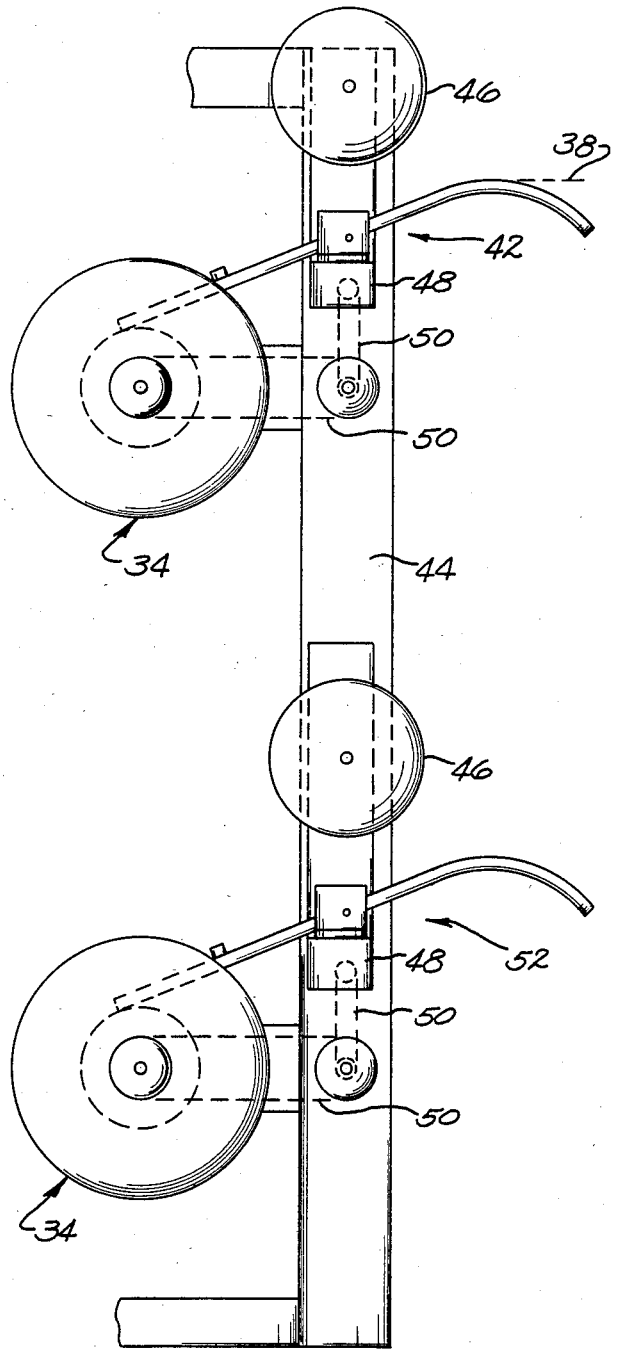
FIG. 7 is a schematic diagram of a contact strip led from stamping apparatus to the reel winding apparatus of the present invention.
Figure 8:
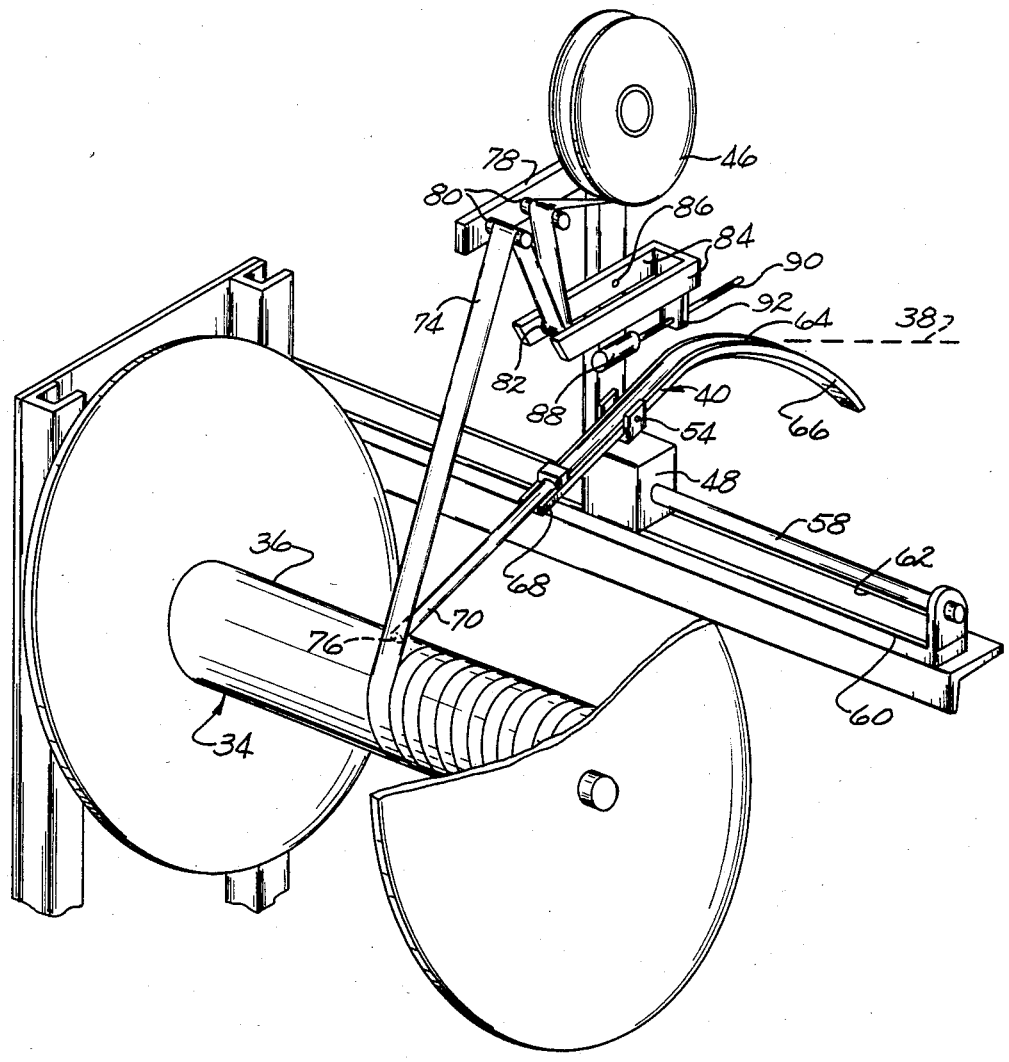
FIG. 8 is a perspective view of a portion of the traverse winding mechanism shown schematically in FIG. 7.
Figure 9:
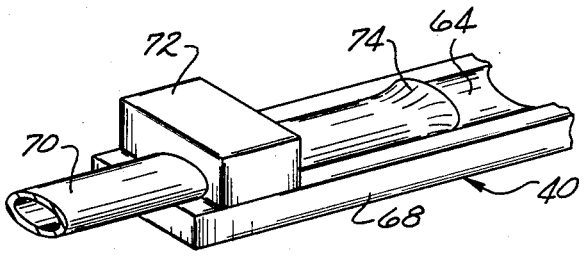
FIG. 9 is an enlarged perspective view of a portion of the guiding mechanism shown in FIG. 8.

With reference to FIGS. 7–9 a contact strip is directed along a path 38 from a source, such as a contact stamping apparatus (not shown), to a pivotable guide member 40 and reel 34 mounted at a top station 42 on support 44. A roll 46 of interliner is mounted at top station 42. An interliner guide is also mounted at station 42 but is not shown in order to simplify the diagram. Details of the interliner guide can be seen in FIG. 8. Guide member 40 and roll 46 are mounted on a traverse mechanism 48 which is driven in synchronization with roll 34 through suitable drive means 50 such as timing belts or the like.

A lower station 52 is also preferably mounted on support 44 so that as soon as reel 34 disposed at station 42 is filled up, the contact strip can be directed to another reel 34 disposed at station 52 without having to interrupt the travel of the carrier strip from its source. A full reel can be removed and an empty one put in place at the top station while the reel is being filled at the bottom station.

As seen in greater detail in FIG. 8, a contact strip is directed along path 38 so that it is received on guide member 40 which is pivotably mounted at 54 on upright leg 56. Leg 56 is fixed to traversing mechanism 48 so that it traverses from side to side along rod 58 and track 60, 62. Guide member 40 is formed with a smooth groove 64 extending along its length in its top surface and has a first downwardly extending curved end 66 and second elliptical tube mounting end 68. Tube 70 is received at end 68 in groove 64 and is held in place by retaining block 72. Tube 70 has a first flared end 74 (see FIG. 9) to provide a smooth transition from the bottom surface of groove 64 for the contact strip and a second end 76 adapted to be received on core 36. A bracket 78 extends toward reel 34 from leg 56 and mounts thereon a pair of transversely extending spaced rods 80 while a third rod 82 extends transversely between two arms 84 of a bracket pivotably mounted on leg 56 at 86. A selected weight 88 is mounted on rod 90 which is adjustably positioned along its length in a bore through tab 92. Interliner 7.4 is trained over the closest one of the pair of rods 80 down under rod 82, up over the other of the pair of rods 80 and down to core 36 of reel 34 with the amount of tension placed on the interliner being adjustable through changes in the effective length of the lever arm utilizing the variably positionable weight 88. As seen in FIG. 8, the end 76 of tube 70 is disposed closely adjacent interliner 7.4 just as it is received on core 36 so that the position of the contact carrier and the interliner can be very effectively controlled. It will be noted that as the reel fills up, tube end 76 will ride up with the increasing diameter of the contact/interliner layers pivoting at 54 with the curved end 66 always presenting a smooth surface for receiving the contact strip along path 38.

The major axis of elliptical tube 70 is horizontal as mounted in groove 64 and is greater than the width of carrier strip 7.1 with depending conductive contact elements. The vertical minor axis is less than the width of the carrier strip and contact elements in order to ensure that the contact strip is presented to reel 34 generally horizontally oriented.

While the invention has been shown and described with reference to particular embodiments thereof, it will be understood by those skilled in the art that the foregoing and other changes in form and detail may be made without departing from the spirit and scope of the invention.

I claim:

1. Apparatus for winding a continuous contact element carrier strip having a selected width on a reel having a core portion with a length a plurality of times greater than the width of the strip comprising a reel support adapted to rotatably support a reel, a traverse mechanism mounted adjacent to the reel support adapted to move back and forth along the length of the reel, the traverse mechanism mounting thereon first and second guide means, the first guide means adapted to direct a strip of interliner onto the core of the reel and the second guide means adapted to direct the carrier strip onto the core of the reel at a location directly in line with the interliner, the second guide means including an elongated member having first and second ends and being pivotably mounted on the traverse mechanism, the pivotable mount located intermediate the first and second ends, the elongated member having a groove extending along its length in a top surface thereof, the carrier strip being receivable in the groove, the second end of the elongated member mounting a first end of an elongated carrier strip receiving tube, the tube having a second free distal end adapted to overlie the core of the reel so that the carrier strip is provided with a positive guide up to the point it is received on the reel, the first end of the elongated member curving downwardly so that as the elongated member pivots due to the increasing effective diameter of the core as the layers build up a smooth transition surface will be presented to the carrier strip as it is received on the member, and means to rotate the reel and move the traverse mechanism back and forth along the length of the reel in synchronization.

2. Apparatus according to claim 1 in which the second guide means is disposed below the first guide means.

3. Apparatus according to claim 1 in which the first end of the tube is flared so that it presents a smooth transition surface from the groove to the internal surface of the tube.

4. Apparatus for winding a continuous contact element carrier strip having a selected width on a reel having a core portion with a length a plurality of times greater than the width of the strip comprising a reel support adapted to rotatably support a reel, a traverse mechanism mounted adjacent to the reel support adapted to move back and forth along the length of the reel, the traverse mechanism mounting thereon first and second guide means, the first guide means adapted to direct a strip of interliner onto the core of the reel and the second guide means adapted to direct the carrier strip onto the core of the reel at a location directly in line with the interliner, the second guide means including an elongated member having first and second ends and being pivotably mounted on the traverse mechanism, the pivotable mount located intermediate the first and second ends, the elongated member having a groove extending along its length in a top surface thereof, the carrier strip being receivable in the groove, the second end of the elongated member mounting a first end of an elongated carrier strip receiving tube, the tube having a second free distal end adapted to overlie the core of the reel so that the carrier strip is provided with a positive guide up to the point it is received on the reel, the tube being elliptical in shape having a horizontal major axis and vertical minor axis, the width of the carrier strip with depending conductive contact elements being greater than the minor axis and less than the major axis to ensure that the carrier strip is properly oriented as it is received on reel, and means to rotate the reel and move the traverse mechanism back and forth along the length of the reel in synchronization.

5. Apparatus accoring to claim 4 in which the second guide means is disposed below the first guide means.

6. Apparatus according to claim 4 in which the first end of the tube is flared so that it presents a smooth transition surface from the groove to the internal surface of the tube.

7. Apparatus for winding a continuous contact element carrier strip having a selected width on a reel having a core portion with a length a plurality of times greater than the width of the strip comprising a reel support adapted to rotatably support a reel, a traverse mechanism mounted adjacent to the reel support adapted to move back and forth along the length of the reel, the traverse mechanism mounting thereon guide means adapted to direct the carrier strip onto the core of the reel, the guide means including an elongated member having first and second ends and being pivotably mounted on the traverse mechanism, the pivotable mount located intermediate the first and second ends, the elongated member having a groove extending along its length in a top surface thereof, the carrier strip receivable in the groove, the second end of the elongated member mounting a first end of an elongated member mounting a first end of an elongated carrier strip receiving tube, the tube having a free distal end adapted to overlie the core of the reel so that the carrier strip is provided with a positive guide up to the point it is received on the reel, the first end of the elongated member curving downwardly so that as the elongated member pivots due to the increasing effective diameter of the core as the layers build up a smooth transition surface will be presented to the carrier strip as it is received on the member, and means to rotate the reel and move the traverse mechanism back and forth along the length of the reel in synchronization.

8. Apparatus according to claim 7 in which the first end of the tube is flared so that it presents a smooth transition surface from the groove to the internal surface of the tube.

9. Apparatus for winding a continuous contact element carrier strip having a selected width on a reel having a core portion with a length a plurality of times greater than the width of the strip comprising a reel support adapted to rotatably support a reel, a traverse mechanism mounted adjacent to the reel support adapted to move back and forth along the length of the reel, the traverse mechanism mounting thereon guide means adapted to direct the carrier strip onto the core of the reel, the guide means including an elongated member having first and second ends and being pivotably mounted on the traverse mechanism, the pivotable mount located intermediate the first and second ends, the elongated member having a groove extending along its length in a top surface thereof, the carrier strip receivable in the groove, the second end of the elongated member mounting a first end of an elongated member mounting a first end of an elongated carrier strip receiving tube, the tube having a free distal end adapted to overlie the core of the reel so that the carrier strip is provided with a positive guide up to the point it is received on the reel, the tube being elliptical in shape having a horizontal major axis and a vertical minor axis, the width of the carrier strip with depending conductive contact elements being greater than the minor axis and less than the major axis to ensure that the carrier strip is properly oriented as it is received on the reel, and means to rotate the reel and move the traverse mechanism back and forth along the length of the reel in synchronization.

10. Apparatus according to claim 9 in which the first end of the tube is flared so that it presents a smooth transition surface from the groove to the internal surface of the tube.

11. Apparatus for winding a continuous contact element carrier strip having a selected width on a reel having a core portion with a length a plurality of times greater than the width of the strip comprising a reel support adapted to rotatably support a reel, a traverse mechanism mounted adjacent to the reel support adapted to move back and forth along the length of the reel, the traverse mounting thereon guide means, the guide means adapted to direct the carrier strip onto the core of the reel, the guide means including a carrier strip receiving tube, the tube being elliptical in shape having a horizontal major axis and vertical minor axis, the width of the carrier strip with depending conductive contact elements being greater than the minor axis and less than the major axis to ensure that the carrier strip is properly oriented as it is received on the reel and means to rotate the reel and move the traverse mechanism back and forth along the length of the reel in synchronization.

12. Apparatus for winding a continuous contact element carrier strip having a selected width on a reel having a core portion with a length a plurality of times greater than the width of the strip comprising a reel support adapted to rotatably support a reel, a traverse mechanism mounted adjacent to the reel support adapted to move back and forth along the length of the reel, the traverse mechanism mounting thereon guide means adapted to direct the carrier strip onto the core of the reel, the guide means including an elongated member having first and second ends and being pivotably mounted on the traverse mechanism, the guide means having a free distal end adapted to overlie the core of the reel so that the carrier strip is provided with a positive guide up to the point it is received on the reel, the first end of the elongated member curving downwardly so that as the elongated member pivots due to the increasing effective diameter of the core as the layers build up a smooth transition surface will be presented to the carrier strip as it is received on the member and means to rotate the reel and move the traverse mechanism back and forth along the length of the reel in synchronization.

* * * * *